US008667736B2

(12) United States Patent
Sullivan

(10) Patent No.: US 8,667,736 B2
(45) Date of Patent: Mar. 11, 2014

(54) TANDEM DRIVE FOR BARRIER

(75) Inventor: Edward S. Sullivan, Addison, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 445 days.

(21) Appl. No.: 12/960,076

(22) Filed: Dec. 3, 2010

(65) Prior Publication Data

US 2012/0137590 A1 Jun. 7, 2012

(51) Int. Cl.
*E01F 13/00* (2006.01)

(52) U.S. Cl.
USPC ..... 49/49; 49/324

(58) Field of Classification Search
USPC ..... 49/49, 324, 348, 356, 333, 334, 335, 49/338; 404/9, 10, 6, 11
See application file for complete search history.

(56) References Cited

U.S. PATENT DOCUMENTS

| | | | | |
|---|---|---|---|---|
| 2,228,909 | A * | 1/1941 | Glowka | 246/294 |
| 2,581,788 | A * | 1/1952 | Dunn | 49/35 |
| 2,842,876 | A * | 7/1958 | Chicoine et al. | 49/35 |
| 5,804,938 | A | 9/1998 | Richmond et al. | |
| 5,869,940 | A | 2/1999 | Parsadayan | |
| 5,873,200 | A | 2/1999 | Henderson | |
| 6,516,567 | B1 | 2/2003 | Stone et al. | |
| 6,935,000 | B1 | 8/2005 | Arnaud | |
| 7,739,834 | B2 | 6/2010 | Stoffels et al. | |
| 7,818,920 | B2 * | 10/2010 | Causey et al. | 49/49 |

FOREIGN PATENT DOCUMENTS

| | | | | |
|---|---|---|---|---|
| EP | 422710 | A1 * | 4/1991 | E01F 13/00 |

* cited by examiner

*Primary Examiner* — Katherine Mitchell
*Assistant Examiner* — Catherine A Kelly
(74) *Attorney, Agent, or Firm* — Fitch Even Tabin & Flannery LLP

(57) ABSTRACT

A barrier apparatus and method are provided to reciprocate a gate or barrier between an open or closed position with one or more linear drives having one or more traveler mechanisms where at least one motor rotates the one or more shafts and moves the traveler mechanisms to move the barrier. The moving traveler mechanisms are coupled to one or more connecting arms which are coupled to the gate and the movement traveler mechanisms push and pull the arms which in turn push and pull the barrier to reciprocate the barrier between and open and closed position. The gate may be rotated and reciprocated around a horizontal axis from a generally vertical position (i.e., generally perpendicular to the ground where access to a controlled area is open) to a generally horizontal position (i.e., generally parallel to the ground where the gate extends across the entryway to the controlled area).

14 Claims, 9 Drawing Sheets

905
903
934
908
904
922
900
936
9a
926
924
918
928
9a
920
945
914
910
902
906
912

924
928
920
914
946
940
941
945
910
951
947
950
914
918
926
922

TANDEM DRIVE FOR BARRIER

FIELD

This application is directed to a drive for a barrier apparatus which reciprocates a gate portion of the barrier apparatus between an open and closed position where a motor drives traveler mechanisms linearly and the traveler mechanisms rock a rocker arm or gate to reciprocate the gate portion between an open and closed position.

BACKGROUND

Various types of movable barrier operators have been used to move various types of barriers throughout the years. In one example, a gate operator rotates a gate arm to control access to an area. The gate arm is lowered to block access to the area and raised to allow access to the area. To mention a few examples, such gate arms are typically used at entrances to parking lots, factories, railroad crossings, or government offices.

One important characteristic for gate operators is that the operators should provide enough force to lift the gate arm from the horizontal position to the vertical position (and vice versa). Another desired characteristic for these systems is that the barrier operator should be small as possible. A small size is desired because the gates are often deployed in confined areas where empty or usable space is at a premium. Thus, some previous approaches have attempted to balance the desire to provide a gate operator with sufficient power to move a gate arm and a gate operator that is of a desirable compact size so that it can fit into the confined spaces where the operator will be deployed.

One attempted solution was the use of hydraulic barrier movement systems. In a hydraulic system, hydraulic arms move the barrier back and forth from a horizontal position to a vertical position and vice versa. Unfortunately, hydraulic systems have suffered from a variety of problems. For instance, hydraulic systems are expensive to manufacture due to the high cost of the hydraulic components and the difficulty in assembling the components together. Additionally, these systems are prone to hydraulic leaks and other problems which increase the maintenance costs of these systems. Repairing the systems is also cumbersome since the many hydraulic components are complicated and difficult for service personnel to access. For instance, it was often challenging for service personnel to access and replace the hydraulic hoses typically used in these systems.

Other types of gate operators have utilized gear arrangements. Unfortunately, these gear arrangements were typically more expensive to manufacture. Additionally, since these operators often used multiple gear reduction stages, they were difficult to service and/or repair.

Whether using hydraulic approaches or gears, previous operators also suffered from performance limitations. More specifically, many of these previous approaches did not guide the barrier arm smoothly along its path and the arm often "hopped" or jerked during movement or when starting or stopping. Additionally, previous approaches were not able to position the barrier arm very precisely. For example, in confined spaces where the arm had to be placed at precise locations to avoid impacting other structures, previous approaches sometimes proved inadequate. Even further, precise placement also permits a barrier to achieve aesthetic goals of permitting the barrier to look better in its environment.

SUMMARY

A barrier apparatus and method are provided to reciprocate a gate or barrier between an open or closed position with one or more linear drives having one or more traveler mechanisms where a motor rotates the one or more shafts and moves the traveler mechanisms to move the barrier. The moving traveler mechanisms are coupled to one or more connecting arms which are coupled to the gate and the movement traveler mechanisms push and pull the arms which in turn push and pull the barrier to reciprocate the barrier between and open and closed position. The gate may be rotated and reciprocated around a horizontal axis from a generally vertical position (i.e., generally perpendicular to the ground where access to a controlled area is open) to a generally horizontal position (i.e., generally parallel to the ground where the gate extends across the entryway to the controlled area).

In one aspect the linear drive may comprise one or more screw shafts having male helical threads threadably engaged to one or more traveler mechanisms with female threads where a motor rotates the one or more shafts which move the traveler mechanisms to move the barrier.

In another aspect, the linear drive comprises two pulleys or sprockets separated by and rotatably mounted on a section of rail. At least one of the pulleys is driven by a motor assembly. Connected to the pulleys or sprockets is a chain or belt loop which loops and engages the pulleys or teeth of the sprockets. Between the pulleys are two trolleys or travelers mounted on the chain or belt. One traveler or trolley is attached to the chain or belt on one side of the rail. The other traveler or trolley is attached to the chain or belt on the other side of the rail. When the motor drives the pulleys or sprockets, the sprockets, the travelers mounted on the chain travel in opposite directions. The travelers are connected to one or more connecting arms which are coupled to the gate and the movement of the travelers push and pull the arms which in turn push and pull the gate to reciprocate the gate between the open and closed positions.

In either aspect the gate may be rotated and reciprocated around a horizontal axis from a generally vertical position (i.e., generally perpendicular to the ground where access to a controlled area is open) to a generally horizontal position (i.e., generally parallel to the ground where the gate or barrier extends across the entryway to the controlled area.

The apparatus and method described herein provide several advantages over previous approaches. One advantage is manufacturing costs are reduced. For instance, since hydraulic components are not employed, the use of expensive hydraulic components can be eliminated. The apparatus and method also eliminate or reduce complicated gearing often required by providing large gear reduction ratios used to reciprocate gates between open and closed positions. The elimination and/or reduction of complicated gearing further reduces costs.

Another advantage of the apparatus and method described herein is that the apparatus is simple and easy to install for later practice of the method. For instance, since hydraulic components are not used, complicated hydraulic lines need not be connected. Once installed, servicing the components is easy since the component count is reduced and layout is simple.

Still another advantage of the present approaches is that they are less susceptible to component failure. For example, hydraulic leaks and other problems associated with hydraulic systems are eliminated since hydraulic components are not used. In some aspects, the number of gears can be significantly reduced or eliminated thereby improving system performance.

Yet another advantage of the present approaches is that they balance the desire to provide a gate operator with sufficient power and a gate operator of a desirable compact size. More specifically, gate operators are provided that supply enough power to move gates or barriers and are also compact enough so as to fit into the confined spaces where the operator will be deployed.

Still another advantage of the present approaches is that performance is enhanced as compared to previous approaches where using the approaches described herein, the barrier arm has more point of connection with the drive unit than previously used. For example, the problem of arm hop is significantly reduced or eliminated and the gate arm can be moved much more precisely as compared to previous approaches. Additional advantages will become apparent with reference to the following.

In one aspect, the apparatus includes at least one screw shaft. In this aspect, the apparatus includes at least one screw shaft which includes a first male helical flight thread having a first lead and a second helical flight thread having a second lead. Generally, the second lead is shorter than the first lead. As used herein, lead is the distance along the axis of the screw shaft that is covered by one complete rotation (360°) of the screw shaft. The first and second helical flights spiral in opposite directions. At least one motor is operatively coupled to the at least one screw shaft to rotate the shaft both clockwise (right handed under the right hand grip rule) and counterclockwise. The apparatus has at least two female threaded traveler mechanisms which traverse the screw shaft along its longitudinal axis. A first traveler mechanism rotationally engages the first helical flight and a second mechanism rotationally engages the second helical flight. The two female threaded traveler mechanisms traverse different axial distances along the screw shaft and its longitudinal axis as the shaft rotates. At least two connecting arms are coupled to the traveler mechanisms. These arms are coupled to the reciprocating gate or barrier such that when the motor is activated, one of the traveler mechanisms traverses upward or downward along the at least one screw shaft according to the direction of shaft rotation. As the at least one shaft rotates, the at least two traveler mechanisms move in the opposite directions along the at least one screw shaft. One of the two moving traveler mechanisms push one of the connecting arms and one of the two moving traveler mechanisms pull one of the connecting arms as the shaft rotates and generates a push force and pull force at the same time on the connecting arms to effect reciprocal rotation of the gate or barrier about a bearing point. As a result, the gate is moved from a generally horizontal closed position to a generally vertical open position and vice versa.

In an important aspect, one screw shaft may be used with two female traveler mechanisms threadably engaged to the screw shaft. In this aspect, the one screw shaft includes a first male helical flight thread having a first lead and a second helical flight thread having a second lead different from the first lead. The first and second helical flights spiral in opposite directions. A motor is operatively coupled to the screw shaft to rotate the shaft both clockwise and counterclockwise. A first traveler mechanism rotationally engages the first helical flight and a second traveler mechanism rotationally engages the second helical flight. The two female threaded traveler mechanisms traverse different axial distances along the screw shaft as the screw shaft rotates. A first connecting arm is coupled to the first traveler mechanism and a second connecting arm is coupled to the second traveler mechanism. The individual connecting arms are coupled to the gate such that when the motor is activated, one of the individual traveler mechanisms traverses upward or downward along the screw shaft according to the direction of shaft rotation, and other of the individual traveler mechanisms moves in the opposite direction along the screw shaft with the other of the two moving traveler mechanisms effective to push one of the connecting arms and one of the two moving traveler mechanisms effective to pull one of the connecting arms as the screw shaft rotates and generates a push force and pull force at the same time on the connecting arms to effect rotation of the gate about a bearing point.

A method for reciprocating a gate around a horizontal axis between a closed horizontal position and an open vertical position also is described herein. In this aspect, the gate has a longitudinal axis generally perpendicular to the horizontal axis around which the gate reciprocatingly rotates. The gate has a short section having a short length and a second long section which has a length longer than the short length. The method includes activating a motor connected to a screw drive shaft having male helical flights and rotating the screw drive shaft with the motor. This rotation moves a first female threaded traveler mechanism and a second female threaded traveler mechanism in an upward or downward movement along the screw shaft. The female threaded traveler mechanisms threadably engage with the male helical flight. The direction of the movement of the first and second traveler mechanisms are a function of the direction of the rotation of the shaft. As a result of the rotation of the shaft and movement of the threaded traveler mechanisms along the shaft, the threaded traveler mechanisms push a first connecting arm with the first threaded traveler with the rotation of the screw shaft while pulling a second connecting arm with the second threaded traveler with the rotational movement of the screw shaft. The pushing and pulling of the connecting arms effect reciprocation of the gate between the closed horizontal position and the open vertical position. The method may be practiced using one screw shaft with helical flights going in the opposite direction on the same shaft. Alternatively, apparatus also may have two screw shafts and the method may be practiced using the two screw shafts, with one helical flight going in one direction and one helical flight going in the opposite direction along a second screw shaft.

In one aspect of the method, as the gate reciprocates between the open and closed positions, the first traveler mechanism travels a distance along the screw shaft which is longer than the distance traveled by the second traveler mechanism. In this aspect the one of the male helical flight threads has a first lead and a second helical flight thread has a second lead. Generally, one of lead is shorter than the other lead which will permit one of the traveler mechanisms to travel a greater distance than the other traveler mechanisms with each rotation of the screw shaft(s). This is because the connector arm connected to the short length of the gate is at distance on the gate which is shorter, as measured from the axis of rotation of the gate, than the distance at the point the first connector arm is connected to the long section of the gate. As a result the arcuate distance traveled by the connector arm end attached to the long length of the gate is greater than the arcuate distance traveled by the connector arm end attached to the short length of the gate.

In yet another aspect, the apparatus described herein includes a reciprocating gate. The gate reciprocates around an axis between a closed position and an open position. The gate has a longitudinal axis generally perpendicular to the ground. The gate has a short section having a short length and a second long section which has a length longer than the short length as measured from the axis around which the gate rotates. In an important aspect the gate reciprocates around a horizontal axis between a closed horizontal position and an open vertical position. In this aspect, the gate has a longitudinal axis generally perpendicular to the horizontal axis around which the gate reciprocatingly rotates. The reciprocating gate includes a gate operator as described above. But in an important aspect, the gate operator has one screw shaft which includes a first male helical flight thread having a first lead and a second helical flight thread having a second lead different from the first lead. The first and second helical flights spiral in opposite directions. A motor is operatively coupled to the screw shaft to rotate the shaft both clockwise and counterclockwise. A first and a second female threaded traveler mechanism rotationally engage the screw drive. The first helical flight and the second traveler mechanism rotationally engage the second helical flight, the second traveler mechanism travels a shorter distance along the screw shaft than the first traveler mechanism as the screw shaft rotates and the gate reciprocates between and open and closed position. A first connecting arm couples the first traveler mechanism to the long length of the gate and a second connecting arm couples the second traveler mechanism to the short length of the gate. The connecting arms are coupled to the gate such that when the motor is activated, one of the individual traveler mechanisms traverses upward or downward along the screw shaft according to the direction of shaft rotation, and the traveler mechanisms move in the same direction along the screw shaft as the gate reciprocates. The two female threaded traveler mechanisms traverse different axial distances along the screw shaft and its longitudinal axis as the shaft rotates because the end of the connecting arm connected to the long section travels a longer arcuate distance the end of the connecting arm connected to the short length of the gate. One of the two moving traveler mechanisms pushes one of the connecting arms and one of the two moving traveler mechanisms pulls one of the connecting arms as the screw shaft rotates and generates a push force and pull force at the same time on the connecting arms to effect reciprocation of the gate about the horizontal axis about which the gate rotates.

Any number of connecting arms can be used to connect the traveler mechanisms with the gate. For example, with a gate having two gate portions to each side of the rotating axis of the gate, two parallel connecting arms can be spaced and connected to each side of the gate portion at the distal end of the gate portion and also connected to each side of the gate portion at a proximate end of the gate.

A first motor may be used to rotate the first shaft and a second motor in sync with the first motor may be used to rotate a second shaft. If a single shaft is used, a pillow block may be deployed on the shaft so that the first and second traveler mechanisms do not come into contact with each other. In operation using two shafts, the two shafts may be rotated in the same direction or different directions depending on how the threads are spiraled on the shaft. For instance, when two threaded shafts are used the first threaded shaft may rotate counter rotationally from the second threaded shaft. Alternatively, the first threaded shaft may rotate in the same direction as the first threaded shaft.

In the aspect of the invention which uses sprockets to move the travelers on a chain or belt which loops around and engages the sprockets or pulleys. A motor is coupled to a drive shaft which rotatably drives one of the sprockets, a drive sprocket, to move a driven sprocket and the chain and travelers which in turn move the barrier.

In other aspects, the present approaches are flexible to various power sources to be used. For instance, solar panels can be easily connected to the system to power the motor.

DETAILED DESCRIPTION

Figure 1:
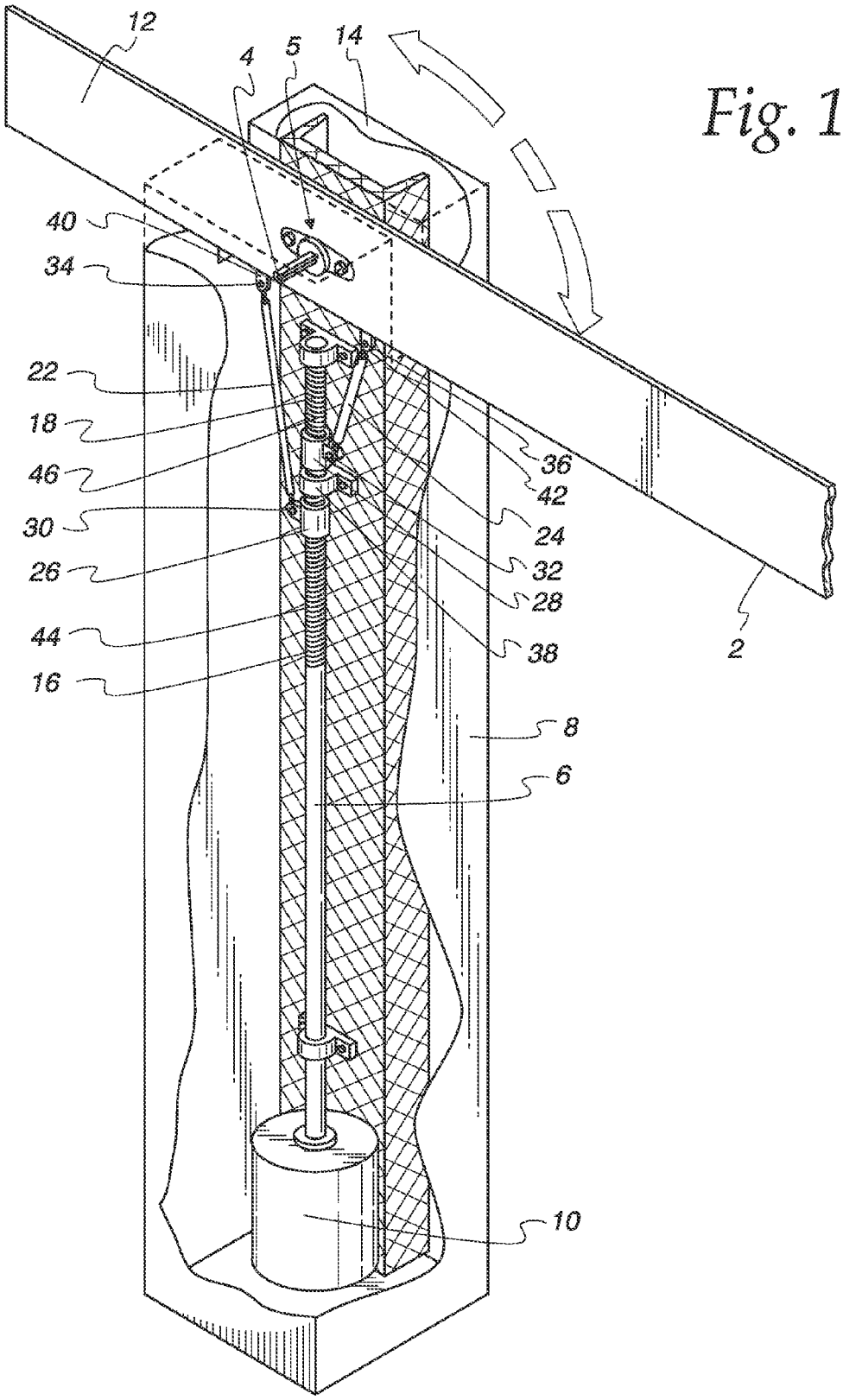
FIG. 1 is a perspective view of a drive for the barrier with a portion of the housing cutaway and in phantom, where the drive includes one screw drive with connecting arms mounted onto travelers and the barrier arm.

As seen in FIG. 1, in one aspect a barrier apparatus includes a reciprocating gate 2 rotatably mounted on a horizontal pivot shaft 4 for reciprocation between a closed position where the gate is horizontal to the ground and an open position where the gate is generally perpendicular to the ground. The horizontal pivot shaft 4 is keyed to a mount 5 secured to the reciprocating gate 2 and is supported by a bearing (not shown) mounted to a support in the barrier apparatus. The barrier apparatus further includes a longitudinal shaft 6 generally vertical to the ground in a housing 8 which encloses the vertical shaft. The housing 8 outline at the top of the barrier apparatus is shown in broken lines and cut away to show the horizontal pivot shaft 4 and mount 5 connected to the reciprocating gate 2. At its lower end, the shaft 6 is rotatably coupled to motor 10 which is coupled to the shaft 6 to rotate it.

The gate has two portions, a short tail portion 12 and a long portion 14 to either side of the pivot shaft 4. The long portion 14 of the gate extends outward from the pivot shaft 4 to block ingress into a controlled area (or egress from the controlled area) when in the closed position when parallel to ground. The tail portion 12 extends from the pivot shaft 4 in the opposite direction from the long portion 14.

The vertical shaft 6 has two threaded sections on the surface of the shaft. The shaft 6 has a first or bottom threaded section 16 and a second or top threaded section 18 spaced from and above the first threaded section. A bottom traveler 26 and top traveler 28 threadably engage the first threaded section and second threaded section, respectively. A trail arm 22 extends from the bottom traveler to the short tail portion of the gate. A lift arm 24 extends from the top traveler 28 to the long section 14 of the gate 2. Each of the arms is pivotally mounted on the travelers and on the gate portions with pins 30, 32, 34 and 36. The threads of threaded sections 16 and 18 are the opposite handed of each other. The threads of the top traveler will engage the threads of top section 18 such that when the motor rotates the shaft, the traveler will run down the shaft as the gate is lowered to its closed position. In this case the threads of 18 are shown as right handed. The threads of the bottom threaded section will be the opposite "handedness" of the threads of the top section. When the motor rotates the shaft and when the threads of the bottom traveler threadedably engage the bottom threads, the traveler will travel up the shaft in the opposite direction of the top traveler as the gate is lowered to its closed horizontal position. The reverse movement of the travelers takes place when the motor is reversed and rotates the shaft in the opposite direction.

A pillow block 38 forms a demarcation between the top of the bottom thread section 16 and the bottom of the top threaded section 18 and prevents the travelers from undesirably going out of engagement with the threads on the shaft. Brackets 40 and 42 are mounted on the lower edge of the gate 2 and have holes or channels through which pins 34 and 36 extend and around which the trail arm and lift arm rotate as they push/pull the gate from the horizontal to the vertical open position and the vertical to horizontal closed position.

In operation to lift the gate from a closed horizontal position, the motor is activated and turns the shaft counter clockwise moving the top traveler up and the bottom traveler down. The bottom traveler pulls the tail portion 12 of the gate down and the top traveler pushes the long portion 14 of the gate up. The trail arm rotates around pins 30 and 34 and the lift arm rotates around pins 32 and 36 as the gate rotates around bearing pin 4 and moves from the horizontal to the vertical. The reverse movement takes place when the gate moves from the vertical to the horizontal, e.g. the top traveler moves down thread threaded section 18 and the bottom traveler moves up thread section 16. The push/pull of the arms creates torque in an amount which is effective to reciprocate the gate around its axis. The torque is created by opposite directional forces at the connection points for the arms on the gate. These forces are applied substantially simultaneously at the connection points.

The leads and the pitch of the threads 44 of the bottom threaded section 16 and 46 of the top threaded section in an important aspect are the same when the trail arm and the lift arm are coupled to the gate at the same longitudinal distance from the horizontal axis 4. If these distances are not the same or symmetrical, then the distances traveled by the travelers would not be the same and the pitches and leads would have to be adjusted accordingly which may make the speeds traveled by the traveler different.

Figure 2:
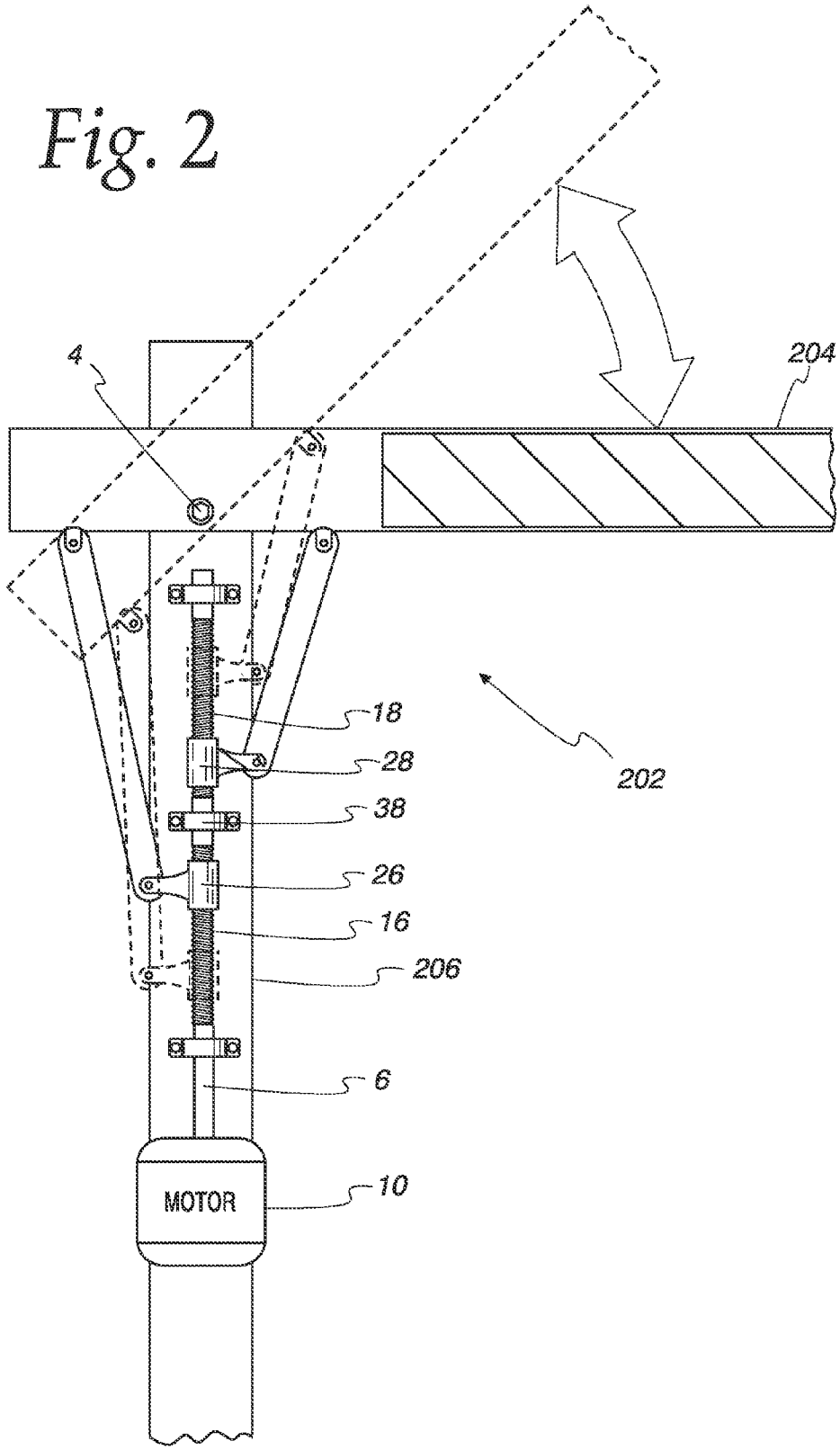
FIG. 2 is a schematic view of a barrier and drive similar to that of FIG. 1 without the housing with an open configuration shown in phantom.

FIG. 2 shows a barrier apparatus 202 similar to that of FIG. 1 with reciprocating gate 204 mounted on a vertical support 206. This barrier apparatus 202 operates in a manner similar to that of FIG. 1 described above.

Figure 3:
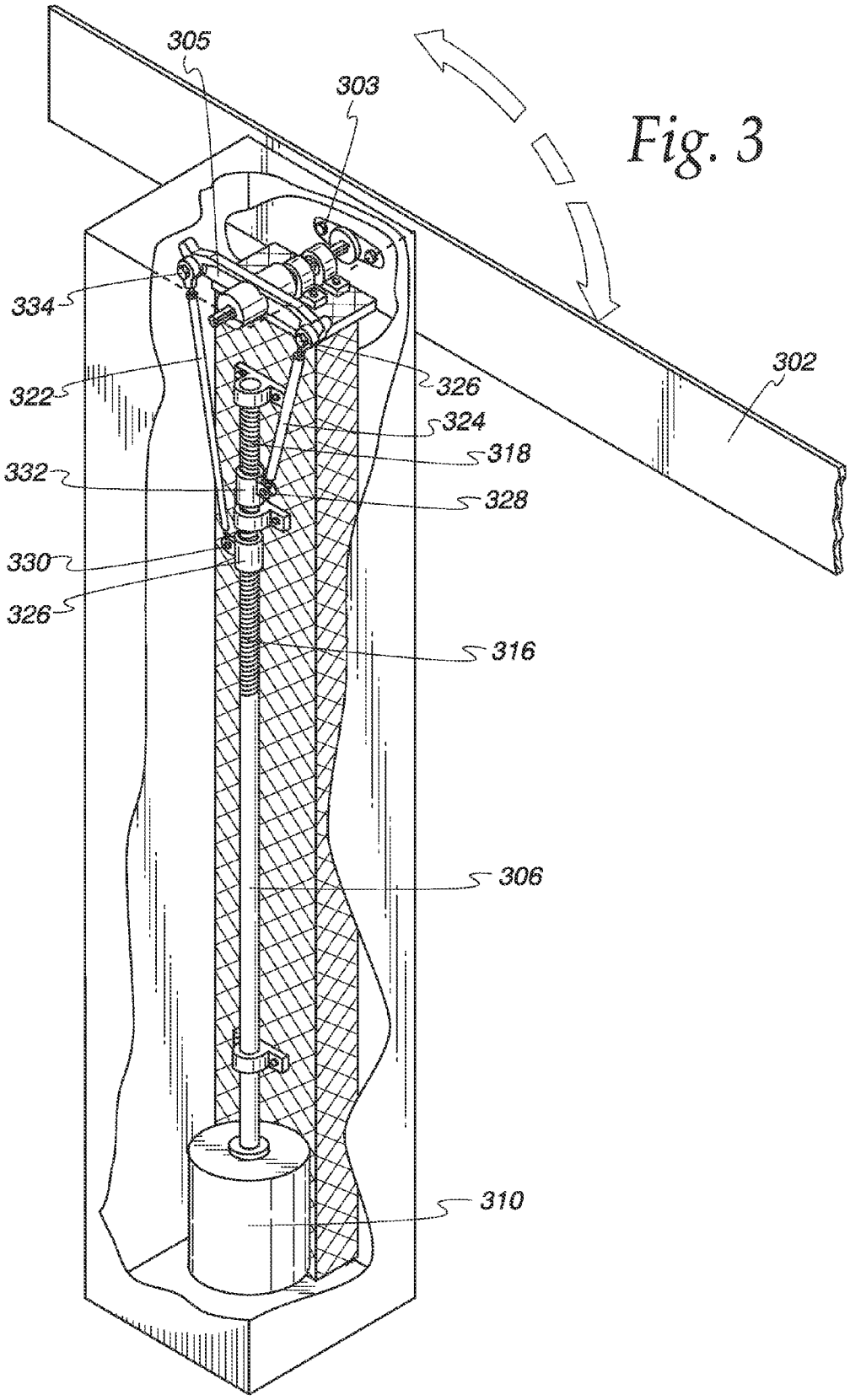
FIG. 3 is a perspective view of a drive for the barrier with a portion of the housing cutaway and in phantom, where the drive includes one screw drive, a rocker arm and yolk which reciprocates the barrier.

FIG. 3 shows another aspect of the invention which uses a rocker arm to move the gate. In this aspect, the gate 302 is mounted on a yolk 303 which is mounted to a rocker arm 305 which may be separate from (as shown in FIG. 3) or incorporated into the gate. The vertical shaft 306 has a bottom threaded section 316 and a top threaded section 318 with a bottom traveler 326 threadably engaging the bottom section 316 and a top traveler 328 threadably engaging the top section 318. Trail arm 322 extends from the bottom traveler to a tail portion of the rocker arm 305. Lift arm 324 extends from the top traveler 328 to the opposite side of the rocker arm 305. Each of the arms is pivotally mounted on the travelers and on the rocker arm with pins 330, 332, 334 and 336. As with the aspect shown in FIG. 1, the travelers move in opposite directions as motor 310 rotates longitudinal shaft 306, and the arms rotate the rocker arm which rotates the gate.

Figure 4:
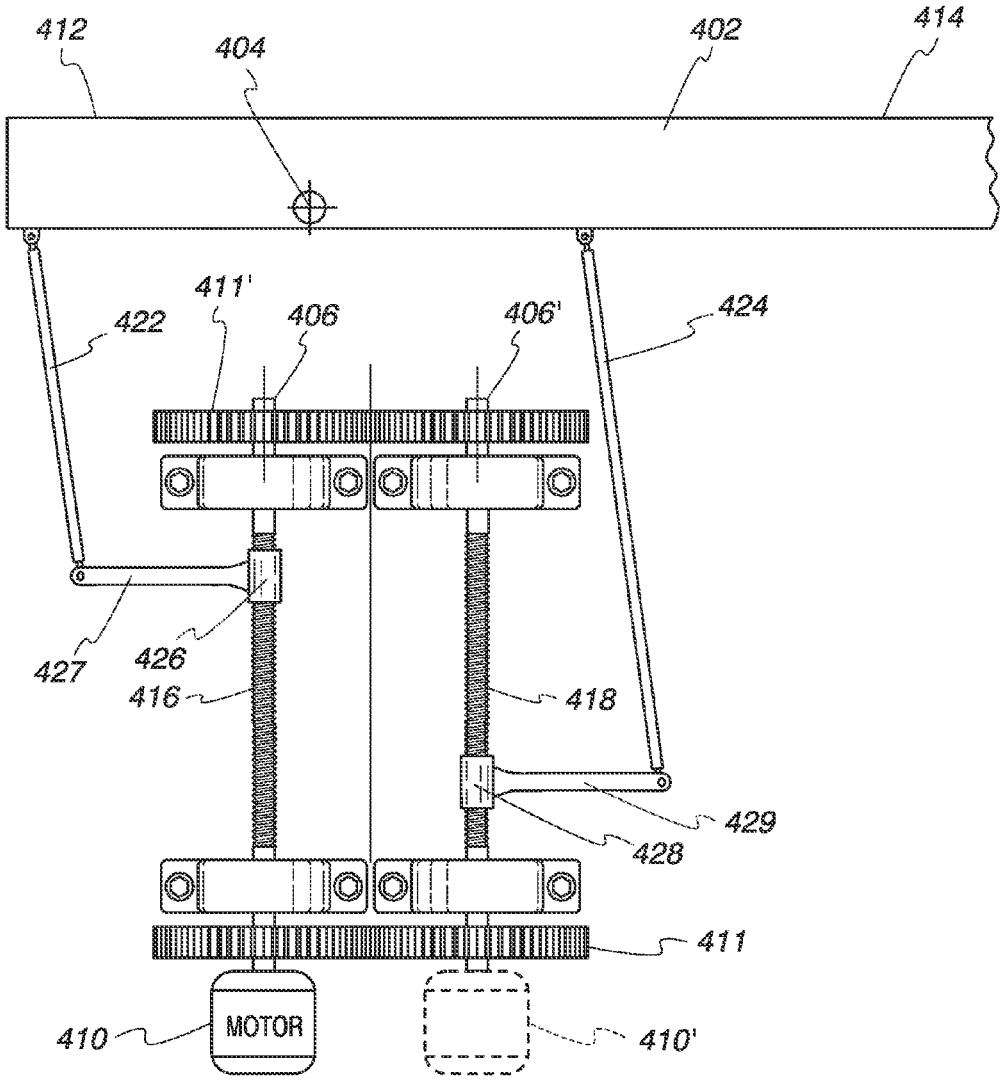
FIG. 4 is a schematic view of the drive for the barrier which includes two screw drives with connecting arms mounted onto travelers and the barrier arm.

FIG. 4 illustrates another aspect of the invention which uses two shafts rotated by a motor, each of the shafts having a traveler which pushes and pulls on arms which rotate the gate. As seen in FIG. 4, the barrier apparatus includes a reciprocating gate 402 rotatably mounted on a horizontal pivot shaft 404 for reciprocation between a closed position where the gate is horizontal to the ground and an open position where the gate is generally perpendicular to the ground. The barrier apparatus further includes two longitudinal shafts 406, 406' generally vertical to the ground in a housing (not shown) which encloses the vertical shaft. At its lower end, the shaft 406 is rotatably coupled to at least one motor 410 to rotate the shaft 406. In one approach individual motors can drive each individual shaft, see 410' shown in phantom lines. In another approach, a set of gears 411 allows a single motor 410 to drive both shafts 406 and 406'. In still another approach, a second set of gears 411' may be added to assist in driving both shafts 406 and 406', although only one set of gears 411 or 411' may be used in a given approach.

The gate has two portions, a short tail portion 412 and a long portion 414 to either side of the pivot shaft 404. The long portion of the gate extends outward from the pivot shaft to block ingress into a controlled area (or egress from the controlled area) when in the closed position when parallel to ground. The tail portion extends from the pivot shaft in the opposite direction from the long portion.

The vertical shafts 406 and 406' have threaded sections on the surface of the shafts. Shaft 406 has a first or bottom threaded section 416 and a second threaded section 418 on shaft 406'. A first traveler 426 and second traveler 428 threadably engage the first threaded section and second threaded section, respectively. A trail arm 422 extends from a connecting arm 427 connected to the first traveler 426 to connect to the short tail portion 412 of the gate. A lift arm 424 extends from a connecting arm 429 connect to the second traveler 428 to connect to the long section 414 of the gate 402. Each of the arms is pivotally mounted on the travelers and on the gate portions with pins 430, 432, 434 and 436. The threads of threaded sections 416 and 418 may be opposite handed of each other. The treads of the second traveler will engage the threads of second threaded section 418 such that when the motor rotates the shaft, the traveler will run up the shaft as the gate is lowered to its closed position. In this case the threads of 418 are right handed. The threads of the first threaded section will be the opposite "handedness" of the threads of the second section. When the motor rotates the shafts and when the threads of the first traveler 426 threadedably engage the threads on shaft 406, the traveler will go up that shaft in the opposite direction of the second traveler 428 on shaft 406' as the gate is lowered to its closed horizontal position. The reverse movement of the travelers takes place when the motor is reversed and rotates the shaft in the opposite direction. When the travelers are far apart with traveler 428 high and traveler 426 low, the gate will be lifted. When the travelers are far apart with traveler 426 high and traveler 428 low, the gate will be in the horizontal position and closed as shown in FIG. 4. In another approach, if the connecting arms 422 and 424 to either side of pivot 404 are the same length, then when the travelers are close together the gate is substantially closed or closed.

In the embodiment shown in FIG. 4, the flights of the threads can go in the same direction, for example, both flights of threads being right or left handed, and the motor is coupled to a gear system 411 and/or 411' which effects counter rotational motion by shafts 406 and 406' such that the travelers 426 and 428 move in opposite directions with the rotation of the shafts. Alternatively, the flights of the screws may go in the opposite directions, for example, one flight of threads is left handed and one flight of threads is right handed which causes the travelers to move in different directions with the shafts 406 and 406' rotating in the same direction, either through connections to different motors 410 and 410' or through appropriate gearing. By way of example, one traveler 426 on shaft 406 goes up while the traveler 428 on shaft 406' goes down as the shafts 406 and 406' are rotated in the same direction.

Figure 5:
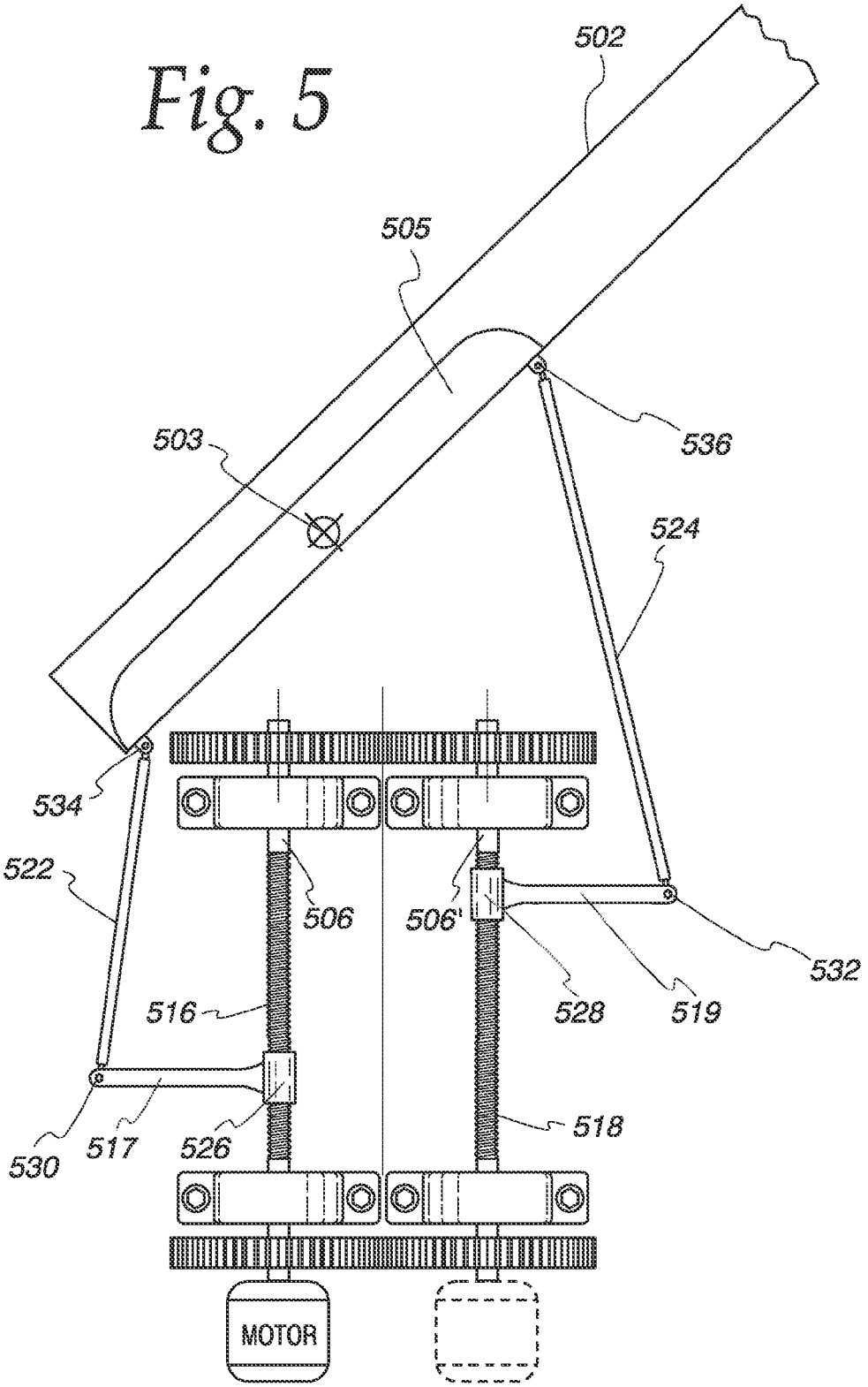
FIG. 5 is a schematic view of the drive for the barrier which includes two screw drives, a rocker arm and yolk which reciprocates the barrier.

FIG. 5 shows another aspect of the invention which uses two shafts instead of one and which also uses a rocker arm to move the gate. In this aspect, the gate 502 is mounted on a yolk 503 which is mounted to a rocker arm 505. The vertical shafts 506 and 506' have a first threaded section 516 and a second threaded section 518 respectively. A first traveler 526 threadably engages the first threaded section 516, and a second traveler 528 threadably engages the second threaded section 518. Trail arm 522 extends from a connecting arm 517 connected to the first traveler 526 to a tail portion of the rocker arm 505. Lift arm 524 extends from a connecting arm 519 connected to the second traveler 528 to the opposite side of the rocker arm 505. Each of the arms 522 and 524 is pivotally mounted to the connecting arms 517 and 519 and on the rocker arm 505 with pins 530, 532, 534 and 536. As with the aspect of the invention shown in FIG. 4, the travelers 526 and 528 move in opposite directions to rotate the rocker arm 505 which rotates the gate 502.

Figure 6:
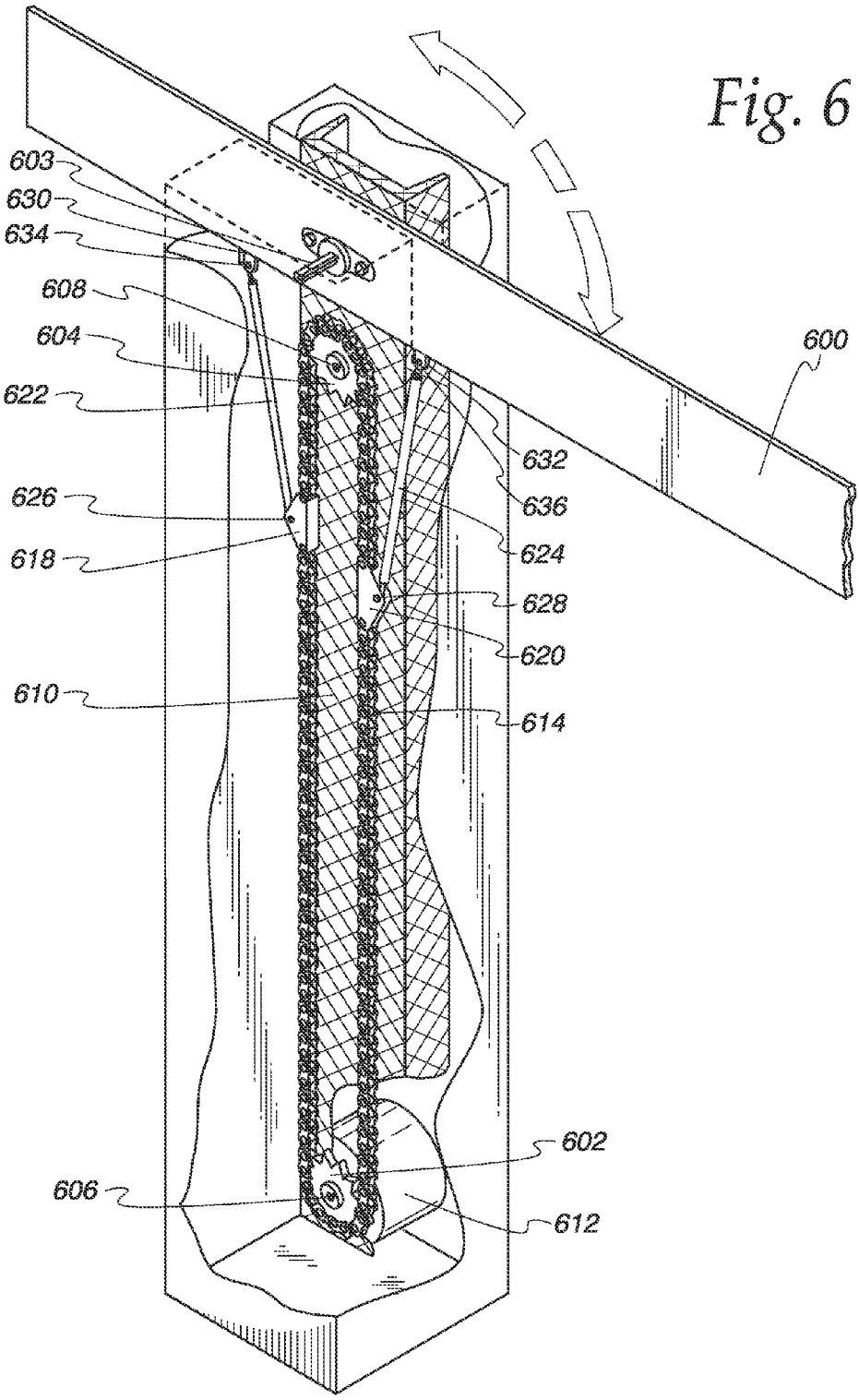
FIG. 6 is a perspective view of a drive for the barrier with a portion of the housing cutaway and in phantom, where the drive includes a chain and two sprockets with two travelers coupled to the chain to drive the barrier.

FIG. 6 illustrates a drive for a barrier which includes a chain and two sprockets with two travelers coupled to the chain to rotate a gate 600 of the barrier around a shaft 603 which is generally horizontal to ground, where the housing cutaway and phantom, gate support, and rotatable coupling is similar to that shown in FIG. 1. In this aspect, a driven sprocket 602 and a drive sprocket 604 are mounted on shafts 606 and 608 respectively. The shafts 606 and 608 are rotatably mounted on a rail 610. Shaft 606 is coupled to motor 612 (shown through a cutaway of the rail 610) to rotatably drive shaft 606 and, through a chain or belt 614, shaft 608. Chain or belt 614 loops around drive sprocket 604 and driven sprocket 602 to engage teeth on the sprockets and move the chain and rotate the sprockets. Travelers 618 and 620 are mounted on the chain or belt 614 on opposite sides of the rail 610. Trail arm 622 and lifting arm 624 are coupled to travelers 618 and 620, respectively, with pins 626 and 628 which extend through holes in the travelers. The distal ends of the arms 622 and 624 away from the travelers are mounted to the gate 600 with brackets 630 and 632 at the bottom edge of the gate. Pins 634 and 636 extend through the arms and holes in the bracket to permit the arms to rotate around the pins as the gate is reciprocated around shaft 603.

In the aspect of the invention where a chain or belt wrapped around sprockets or pulleys is used to move and reciprocate the gate, the motor is activated and drives the drive sprocket which moves the chain and the travelers. As one traveler moves up the other traveler on the other side of the rail moves down. The travelers in turn push and pull the arms 622 and 624 to reciprocate or rotate gate 600 around shaft 603.

Figure 7:
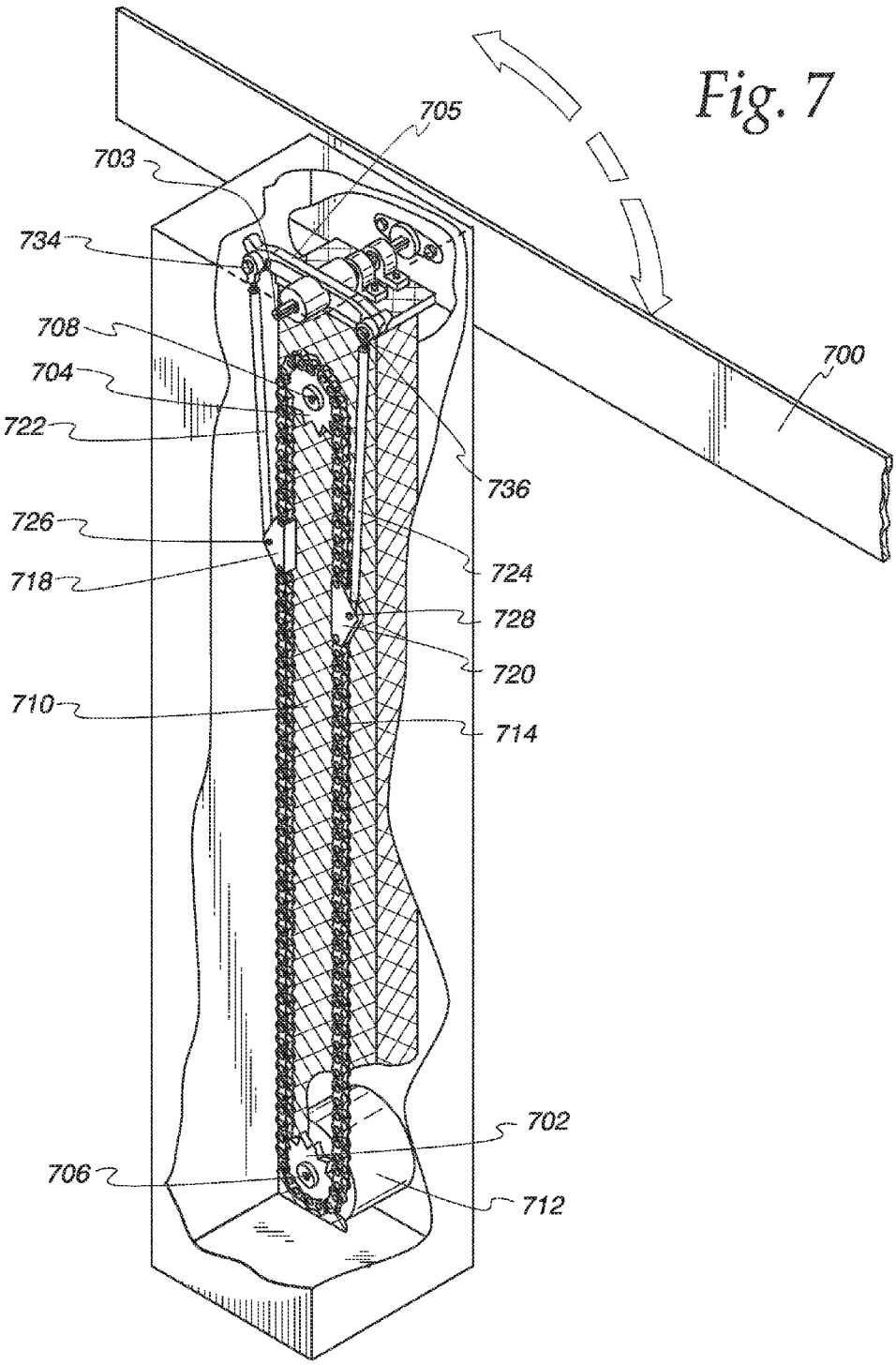
FIG. 7 is a perspective view of a drive for the barrier with a portion of the housing cutaway and in phantom, where the drive includes a chain and two sprockets with two travelers and a rocker arm.

FIG. 7 illustrates a drive for a barrier which includes a chain and two sprockets with two travelers coupled to the chain to rotate gate 700 of the barrier around shaft 703 which is approximately horizontal to ground. In this aspect of the invention, a driven sprocket 702 and a drive sprocket 704 are mounted on shafts 706 and 708 respectively. The shafts are rotatably mounted on a rail 710 similar to the arrangement of FIG. 6. Shaft 706 is coupled to motor 712 to rotatably drive shaft 706 and shaft 708. Chain or belt 714 loops around drive sprocket 704 and driven sprocket 702 to engage teeth on the sprockets and move the chain and rotate the sprockets. Travelers 718 and 720 are mounted on the chain or belt on opposite sides of the rail. Trail arm 722 and lifting arm 724 are coupled to travelers 718 and 720 with pins 726 and 728 which extend through holes in the travelers. The distal ends of the arms 722 and 724 away from the travelers are mounted to a rocker arm 705 that reciprocates the gate 700 via shaft 703. Pins 734 and 736 extend through the arms 722 and 724 and holes in the rocker arm 705 to permit the trail arm 722 and lifting arm 724 to rotate and rock the rocker arm 705.

Figures 8, 8A:
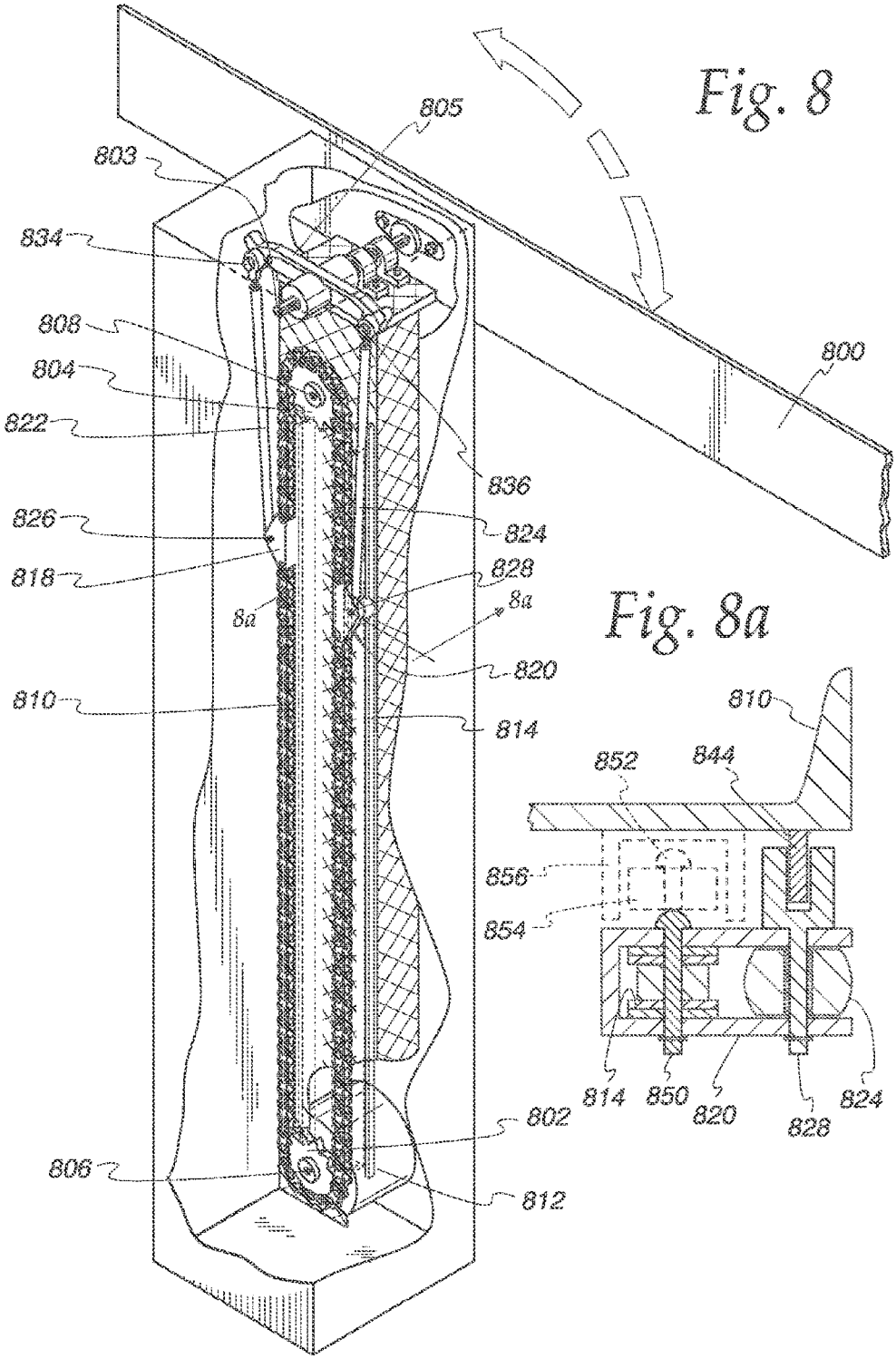
FIG. 8 is a perspective view of a drive for the barrier with a portion of the housing cutaway and in phantom, where the drive includes a chain and two sprockets with two travelers with one or more guide tracks.
FIG. 8*a* is a top view of a cross section along line 8*a* of FIG. 8 showing two approaches to engaging a guide track with a traveler.

FIG. 8 illustrates a drive for a barrier which includes a chain and two sprockets with two travelers coupled to the chain to rotate gate 800 of the barrier around shaft 803 which is approximately horizontal to ground. In this aspect of the invention, a driven sprocket 802 and a drive sprocket 804 are mounted on shafts 806 and 808 respectively. The shafts are rotatably mounted on a rail 810 similar to the arrangement of FIG. 6. Shaft 806 is coupled to motor 812 to rotatably drive shaft 806 and shaft 808. Chain or belt 814 loops around drive sprocket 804 and driven sprocket 802 to engage teeth on the sprockets and move the chain and rotate the sprockets. Travelers 818 and 820 are mounted on the chain or belt on opposite sides of the rail. Trail arm 822 and lifting arm 824 are coupled to travelers 818 and 820 with pins 826 and 828 which extend through holes in the travelers. The distal ends of the arms 822 and 824 away from the travelers are mounted to a rocker arm 805 that reciprocates the gate 800 via shaft 803. Pins 834 and 836 extend through the arms 822 and 824 and holes in the rocker arm 805 to permit the trail arm 822 and lifting arm 824 to rotate and rock the rocker arm 805.

FIG. 8*a* illustrates example configurations for supporting and guiding the travel of a traveler 820 using a guide track. In one approach, the pin 828 supporting the lifting arm 824 includes an extension 840 that defines a slot 842. The slot 842 is sized to receive the guide track 844 that is mounted to the rail 810. When the traveler 820 moves, the extension 840 engages the track 844 to guide the movement of the traveler 820. In another approach shown in phantom, a pin 850 that secures the traveler 820 to the chain 814 is extended 852 to support a wheel 854. A guide track 856 is configured to receive and engage the wheel 854 to guide movement of the traveler 820 when moved by the motor 812.

Figure 9:
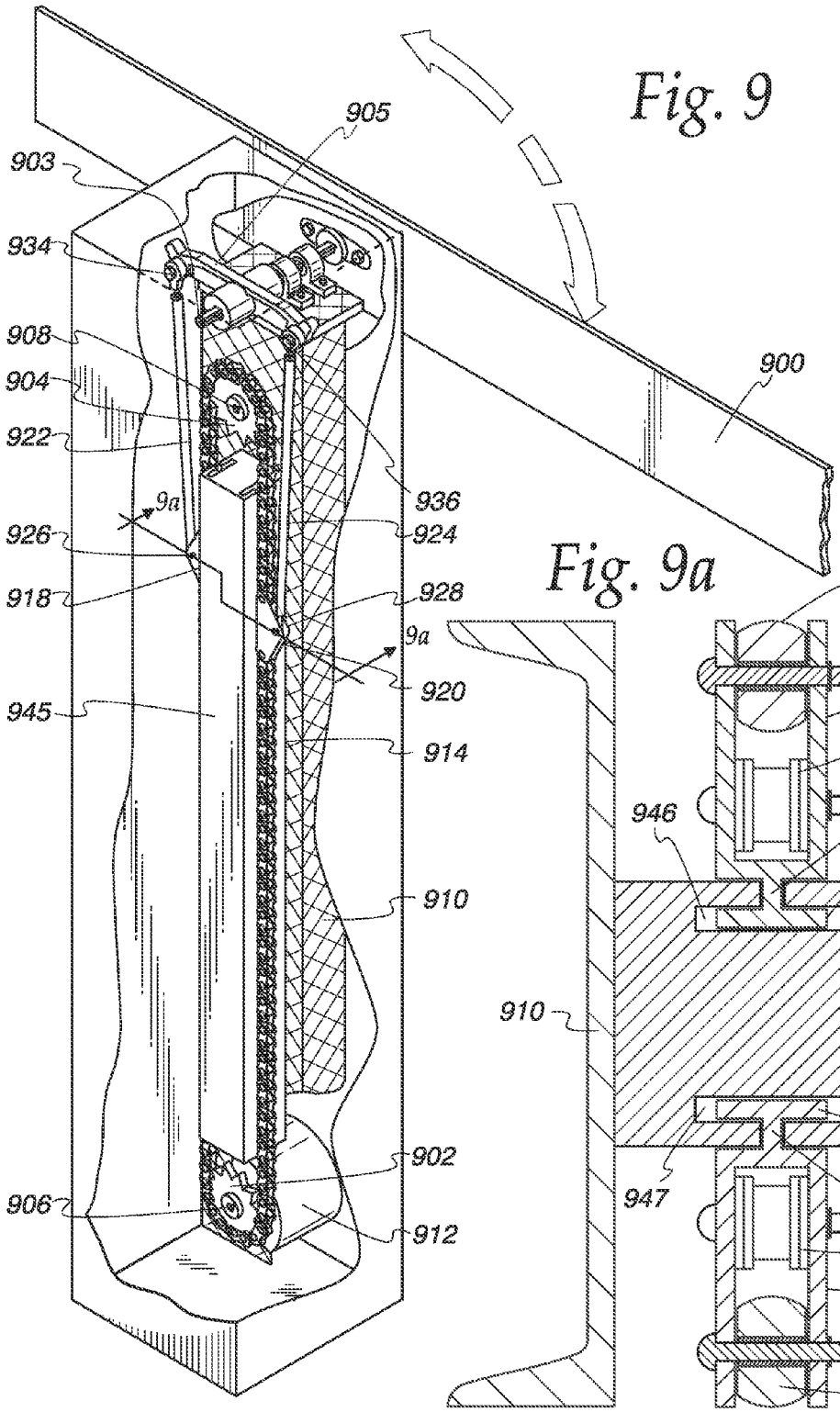
FIG. 9 is a perspective view of a drive for the barrier with a portion of the housing cutaway and in phantom, where the drive includes a chain and two sprockets with two travelers engaging a central guide track.

FIG. 9 illustrates a drive for a barrier which includes a chain and two sprockets with two travelers coupled to the chain to rotate gate 900 of the barrier around shaft 903 which is approximately horizontal to ground. In this aspect of the invention, a driven sprocket 902 and a drive sprocket 904 are mounted on shafts 906 and 908 respectively. The shafts are rotatably mounted on a rail 910 similar to the arrangement of FIG. 6. Shaft 906 is coupled to motor 912 to rotatably drive shaft 906 and shaft 908. Chain or belt 914 loops around drive sprocket 904 and driven sprocket 902 to engage teeth on the sprockets and move the chain and rotate the sprockets. Travelers 918 and 920 are mounted on the chain or belt on opposite sides of the rail. Trail arm 922 and lifting arm 924 are coupled to travelers 918 and 920 with pins 926 and 928 which extend through holes in the travelers. The distal ends of the arms 922 and 924 away from the travelers are mounted to a rocker arm 905 that reciprocates the gate 900 via shaft 903. Pins 934 and 936 extend through the arms 922 and 924 and holes in the rocker arm 905 to permit the trail arm 922 and lifting arm 924 to rotate and rock the rocker arm 905.

Figure 9A:
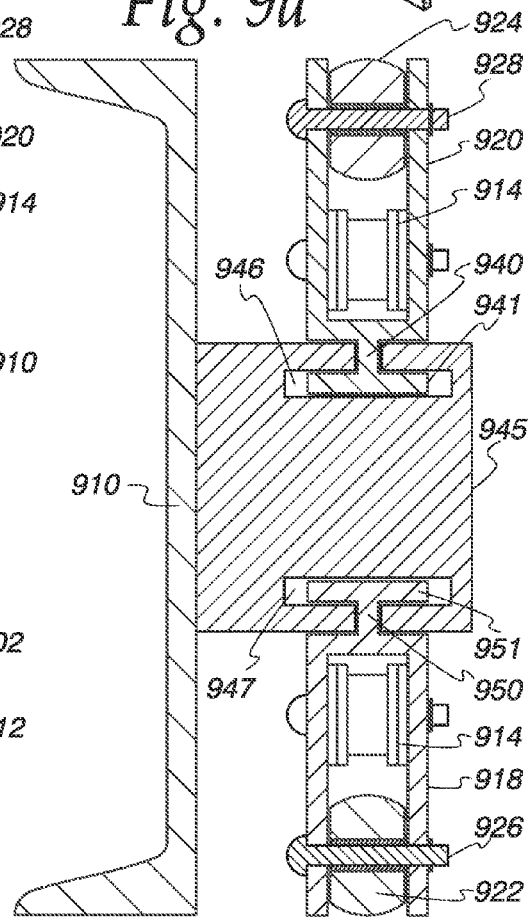
FIG. 9*a* is a top view of a cross section along line 9*a* of FIG. 9 showing one approach to engaging a center guide track with both travelers.

FIG. 9*a* illustrates another example configuration for supporting and guiding the travel of travelers 918 and 920 using a guide track. In one approach, the traveler 920 includes an extension 940 that attached to a flange 941. A guide track 945 is mounted to or integral with the rail 910 and defines slots 946 and 947 that are configured to receive the flange 941 of the traveler 920. The second traveler 918 includes an extension 950 and flange 951 configured to slide into the slot 947. When the travelers 918 and 920 move, the flanges 941 and 951 engage the track 945 at the slots 946 and 947 to guide the movement of the travelers 918 and 920. The approaches to the guide tracks shown in FIGS. 8*a* and 9*a* are merely examples and other configurations of travelers engaging guide tracks are possible.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A barrier operator, comprising:

at least one motor and;

a drive pulley coupled to the motor through a mechanism so that when the motor rotates the drive pulley rotates;

a second pulley;

a flexible coupling member connected to the drive and second pulley;

at least one track having a flange extending therefrom;

at least one traveler, the at least one traveler comprising a U-shaped engagement member engaging the at least one track by enclosing the flange and configured to restrict movement of the at least one traveler in a first direction and a second direction substantially opposite the first direction; wherein the at least one traveler is connected to the flexible coupling member on one side of the drive pulley;

at least one connecting arm that is coupled to the at least one traveler and is operatively connected to a barrier such that when the at least one motor is activated, the at least one traveler traverses along the at least one track according to the direction of drive pulley rotation, the traveler being effective to move the at least one connecting arm and generate a torque that rotates the barrier about an axis.

2. A barrier operator, comprising:

at least one motor and;

a drive pulley coupled to the motor through a mechanism so that when the motor rotates the drive pulley rotates;

a second pulley;

a flexible coupling member connected to the drive and second pulley;

at least one track;

at least one traveler configured to follow the at least one track, wherein the at least one traveler comprises a first traveler and a second traveler wherein the first traveler is connected to the flexible coupling member on the one side of the drive pulley and the second traveler is connected to the flexible coupling member on an opposite side of the drive pulley, and wherein the at least one traveler is connected to the flexible coupling member on one side of the drive pulley;

at least one first connecting arm that is coupled to the first traveler and is operatively connected to a barrier such that when the at least one motor is activated, the first traveler traverses along the at least one track according to the direction of drive pulley rotation, the first traveler being effective to move the at least one first connecting arm and generate a torque that rotates the barrier about an axis; and at least one second connecting arm that is coupled to the second traveler and is operatively connected to the barrier such that when the at least one motor is activated, the second traveler traverses along the at least one track according to the direction of drive pulley rotation, the second traveler being effective to move the at least one second connecting arm and generate a torque that rotates the barrier about the axis.

3. The operator of claim 2 wherein the first and second travelers are configured to engage the at least one track.

4. The operator of claim 2 wherein the at least one track comprises at least two tracks.

5. The operator of claim 2 wherein the first traveler is configured to engage a first track of the at least one track and the second traveler is configured to engage a second track different from the first track.

6. The operator of claim 5 wherein the first track is parallel to the second track.

7. The operator of claim 1 wherein the barrier is movable about the axis from a generally horizontal position to a generally vertical position and vice versa.

8. The operator of claim 5 wherein the at least one first connecting arm is coupled to the barrier at a first connection point, and the at least one second connecting arm is connected to the barrier at a second connection point.

9. The operator of claim 8 wherein the torque is generated by creating opposite directional forces at the first connection point and the second connection point.

10. The operator of claim 8 wherein the opposite directional forces are applied simultaneously at the first connection point and the second connection point.

11. The operator of claim 1 wherein the at least one connecting arm is coupled to the barrier via a rocker arm.

12. The operator of claim 11 wherein the rocker arm is incorporated into the barrier.

13. The operator of claim 11 wherein the rocker arm is separate from the barrier.

14. A barrier operator, comprising:

at least one motor and;

a drive pulley coupled to the motor through a mechanism so that when the motor rotates the drive pulley rotates;

a second pulley;

a flexible coupling member connected to the drive and second pulley;

at least one traveler, wherein the at least one traveler comprises a first traveler and a second traveler wherein the first traveler is connected to the flexible coupling member on the one side of the drive pulley and the second traveler is connected to the flexible coupling member on an opposite side of the drive pulley, and wherein the at least one traveler is connected to the flexible coupling member on one side of the drive pulley;

at least one first connecting arm that is coupled to the first traveler and is operatively connected to a barrier such that when the at least one motor is activated, the first traveler traverses according to the direction of drive pulley rotation, the first traveler being effective to move the at least one first connecting arm and generate a torque that rotates the barrier about an axis; and at least one second connecting arm that is coupled to the second traveler and is operatively connected to a barrier such that when the at least one motor is activated, the second traveler traverses according to the direction of drive pulley rotation, the second traveler being effective to move the at least one second connecting arm and generate a torque that rotates the barrier about the axis.

* * * * *

UNITED STATES PATENT AND TRADEMARK OFFICE

CERTIFICATE OF CORRECTION

PATENT NO. : 8,667,736 B2
APPLICATION NO. : 12/960076
DATED : March 11, 2014
INVENTOR(S) : Edward S. Sullivan It is certified that error appears in the above-identified patent and that said Letters Patent is hereby corrected as shown below:

IN THE CLAIMS:

Column 11, Claim 1, Line 35: After "motor" delete "and";

Column 11, Claim 2, Line 59: After "motor" delete "and"; and

Column 12, Claim 14, Line 54: After "motor" delete "and".

Signed and Sealed this
First Day of July, 2014

Michelle K. Lee

Michelle K. Lee
*Deputy Director of the United States Patent and Trademark Office*